US005528797A

United States Patent [19]

Otmar et al.

[11] Patent Number: 5,528,797

[45] Date of Patent: Jun. 25, 1996

[54] DEVICE TO SWIVEL A TRAVERSING FLAT CAN ON A TEXTILE MACHINE WHICH DELIVERS A FIBER SLIVER

[75] Inventors: Kovacs Otmar, Dietfurt; Ueding Michael, Ingolstadt, both of Germany

[73] Assignee: Rieter Ingolstadt Spinnereimaschinenbau AG, Ingolstadt, Germany

[21] Appl. No.: 426,568

[22] Filed: Apr. 21, 1995

[51] Int. Cl.[6] ..... D01G 27/00

[52] U.S. Cl. ..... 19/159 R

[58] Field of Search ..... 19/159 R, 159 A, 19/160, 163

[56] References Cited

U.S. PATENT DOCUMENTS

| | | | |
|---|---|---|---|
| 2,546,557 | 3/1951 | Naegeli | 19/159 R |
| 3,339,244 | 9/1967 | Van Deusen | 19/159 R X |
| 5,237,726 | 8/1993 | Gartenmann et al. | 19/159 A X |
| 5,428,869 | 7/1995 | Holubec et al. | 19/159 R |
| 5,450,656 | 9/1995 | Ueding et al. | 19/159 R |

*Primary Examiner*—Ismael Izaguirre
*Attorney, Agent, or Firm*—Dority & Manning

[57] ABSTRACT

A device for imparting swivelling motion to a traversing flat can of a textile machine includes a traversing mechanism configured to drive the flat can between return points along a back-and-forth traversing path relative to the textile machine. The traversing mechanism has grasping plate devices for grasping the flat can therebetween. The device has a swivelling mechanism configured to alternately swivel the flat can in opposite directions at the return points of the traversing path. The swivelling mechanism includes rollers which are rotatable about eccentric axles. The rollers may be disposed either above the grasping plates or below the grasping plates of the traversing mechanism.

17 Claims, 6 Drawing Sheets

DEVICE TO SWIVEL A TRAVERSING FLAT CAN ON A TEXTILE MACHINE WHICH DELIVERS A FIBER SLIVER

BACKGROUND OF THE INVENTION

The present invention relates to a device for the back-and-forth swivelling of a traversing flat can on a textile machine which delivers a fiber sliver into the traversing flat can. At the return point of a traversing path the flat can is swivelled by a swivelling device around a swivelling axis. Swivelling takes place perpendicularly to the traversing path, whereby the flat can is swivelled in a perpendicular direction and is traversed in this swivelled position. At the return point of the traversing path the flat can is swivelled back in the opposite perpendicular position across the traversing path and is now traversed in this position.

The German application P 43 24 951.5 shows a swivelling device in interaction with a traversing device, whereby the flat can is imparted a swivelling force in the lower area of the can. The traversing device according to P 43 24 951.5 has a conveying path on which it is possible to traverse a flat can. The conveying path is configured so that the swivelling movement of the flat can may also be ensured. On both sides of the conveying path, thrust beams are provided. During traversing the thrust beams with their rollers press with their rollers against the flat can. The thrust beams are controlled in such a manner that they exert thrust perpendicularly to the traversing path at the return point of the traversing path. The flat can is shifted perpendicularly to the next return point and then is again shifted perpendicularly in the opposite direction. Because of the thrust beams, this thrusting device is complex in structure and cost-intensive.

OBJECTS AND SUMMARY OF THE INVENTION

It is a principal object of the instant invention to provide a device for the swivelling of a flat can in combination with a traversing device for a flat can on a textile machine which delivers a fiber sliver, the device being less structurally complex and less expensive than such devices available in the art. Additional objects and advantages of the invention will be set forth in part in the following description, or may be obvious from the description, or may be learned through practice of the invention.

The objects are attained in that a swivelling device is provided at the level of the upper can area as related to the float can. Here the can area is an area located between the upper can rim and a grasping plate which grasps the flat can by means of a grasping device. In this area the swivelling device takes effect and this is where it is preferably located. The swivelling device has two imparters of swivelling motion as operating means. The imparters of swivelling motion are each installed in proximity of the upper can areas on either side of the flat can. In an advantageous embodiment they are located on the lower machine table and facing each other across a rotary plate. The imparters of swivelling motion not only impart the swivelling motion to the flat can in the upper can area, but at the same time provide guidance during traversing. When the flat can reaches a return point of its traversing path, both imparters of swivelling motion swivel the flat can by a fixed amount perpendicularly to the traversing path. The flat can is thus swivelled around its swivelling axis by a fixed angle. In this position the flat can traverses back to the other return point. Upon reaching the other return point the imparters of swivelling motion swivel the flat can into the opposite perpendicular direction across the traversing path. This process is repeated until the can is full and a can replacement is indicated.

The imparters of swivelling motion are preferably made in the form of rollers which are provided with an eccentric axis. In a very advantageous embodiment, the rollers are located across from each other with their axes on either side of a rotary plate at the underside of the machine table. Synchronous rotation of both rollers with their eccentric axes according to a fixed angle results in swivelling the flat can around its swivelling axis. The rotation of a roller is achieved by a controlled cylinder which meshes with an adjusting lever of the roller. The control makes it possible to lift or pull the piston rod of a cylinder so that the roller can be rotated by a required angle with its eccentric axis. The surface shell of a roller can be rotated relative to the base body of the roller. Since the roller presses against the side of the can, rotation of the roller causes the flat can to be swivelled perpendicularly to the traversing path. The design of the imparter of swivelling motion in the form of rollers is especially advantageous because an extremely low structural effort is needed to produce a swivelling motion while at the same time advantageous guidance of the flat can during traversing is ensured. This type of guidance is advantageously low-friction. Another advantage is that during traversing of the flat can on a conveying path, the conveying path at the bottom is freed of a swivelling device so that greater accessibility to the conveying system exists during can replacement.

DETAILED DESCRIPTION OF THE PREFERRED EMBODIMENTS

Figure 1:
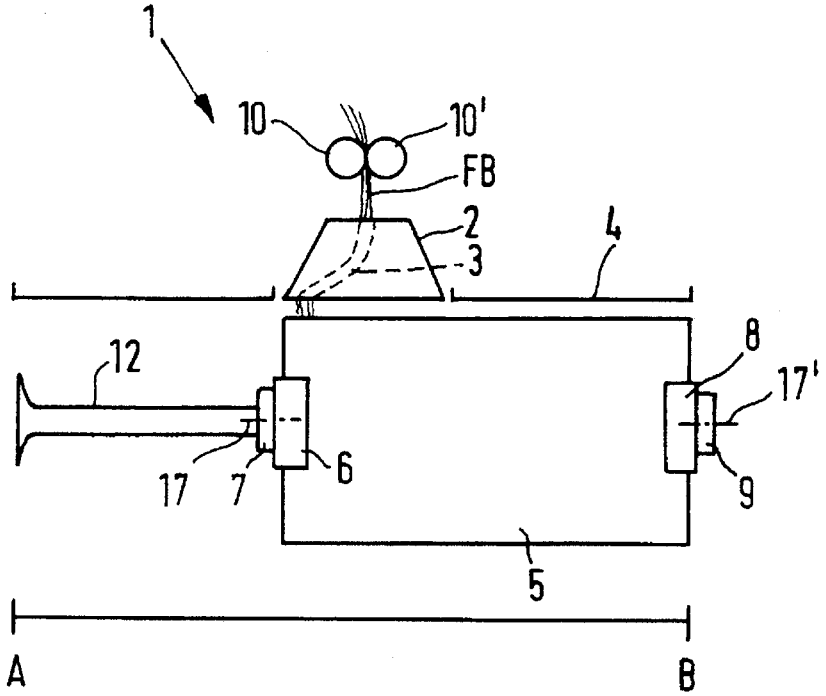
FIG. 1 shows a depositing device of a draw frame with flat can and traversing device.

Reference will now be made in detail to the presently preferred embodiments of the invention, one or more examples of which are illustrated in the drawings. Each example is provided by way of explanation of the invention, and not meant as a limitation of the invention. For example, variations and modifications can be made in the present invention without departing from the scope or spirit of the invention. Also, the numbering of components is consistent throughout the description and drawings, with the same components having the same number throughout.

FIG. 1 shows the depositing device 1 of a draw frame of the textile industry. A depositing device of a carding frame could however also apply, with essential features being described hereinafter on the frame. Both are textile machines for delivering fiber slivers. In the machine table 4, a rotary plate 2 with sliver guiding channel 3 is installed. Above the sliver guiding channel 3 is a pair of calendar rollers 10, 10'. During the filling of a flat can the pair of calendar rollers 10, 10' conveys the fiber sliver FB into the sliver guiding channel 3 of rotary plate 2 which deposits this fiber sliver cycloidally in a flat can 5. During the depositing of the fiber sliver FB, the flat can 5 is traversed on the traversing path A B. In this process the can is grasped by a grasping device. The can is therefore located between the grasping plates 6, 8 which are part of a grasping device. The grasping plate 6 is mounted rotatably in a grasping arm 7 so as to be rotatable about axis 17. The grasping plate 8 is rotatably mounted in the grasping arm 9 and is rotatable about axis 17'. Grasping arms 7, 9 together with grasping plates 6, 8 traverse the flat can 5 along a rail 12 with a stop. The stops of the rail 12 coincide with the return points A or B of the traversing path A B. The flat can 5 can be traversed as it hangs freely or it can be traversed while standing on a conveyor.

Figure 3:
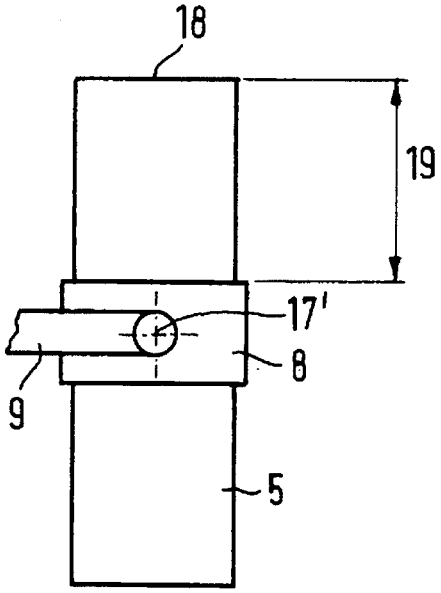
FIG. 3 shows the upper area of a flat can.
Figure 2:
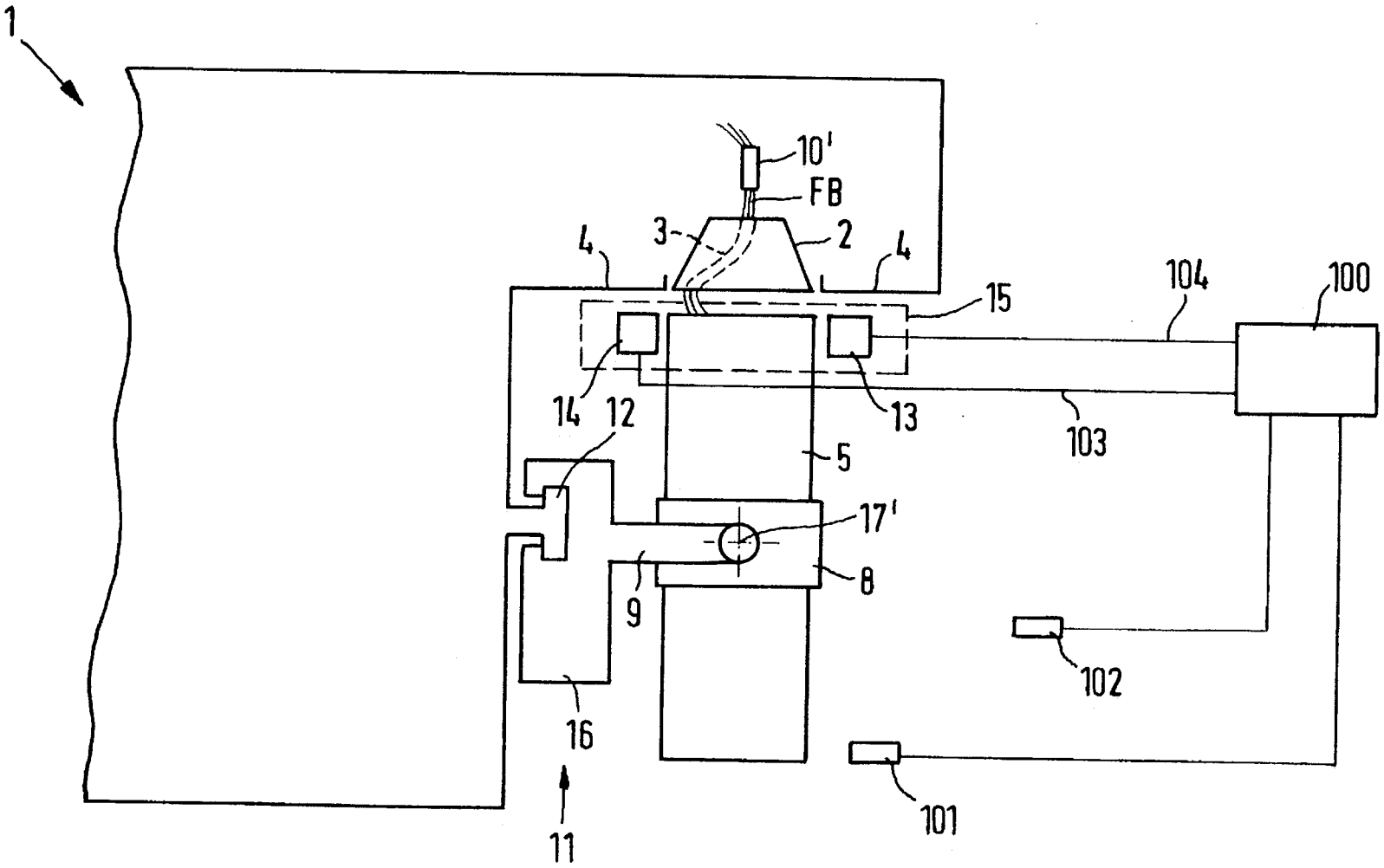
FIG. 2 shows a flat can with traversing device and swivelling device.

FIG. 2 shows a lateral view of FIG. 1, making it possible to see that the traversing device 11 is provided with a traversing carriage 16 which is able to travel on the rail 12. The traversing carriage 16 possesses grasping arms. A grasping arm 9 with grasping plate 8 is shown in a side view. In the upper can area a swivelling device 15 is installed. The swivelling device 15 has imparters of swivelling motion 13, 14 as its operating means. The imparters of swivelling motion are located on both sides in the upper can area. In order to keep the number of required imparters of swivelling motion low, these are located at the underside of the machine table, advantageously in proximity of the rotary plate in an arrangement of 2 imparters of swivelling motion in the upper can area. FIG. 3 explains the upper can area. The upper can area 19 is delimited by the upper can rim 18 and by the grasping plates 6, 8 which are holding the flat can. In this upper can area 19 the swivelling device 15, together with the imparters of swivelling motion 13, 14, will be selectively located. In general, the placement of the swivelling device in a lower can area is also possible. A lower can area would be defined similarly to the upper one. This is however less advantageous.

An arrangement in the upper can area 19 is more advantageous because interference by a can conveying system operating in the lower can area is thus avoided. This conveying system is not shown for the sake of clarity.

Figure 4:
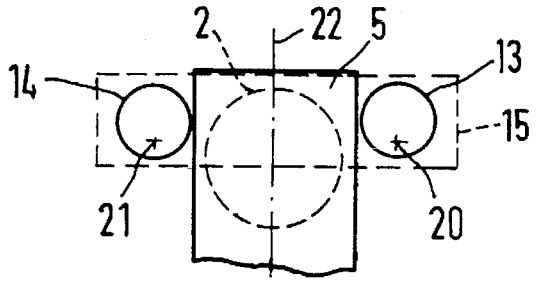
FIG. 4 shows a top view of parts of the depositing surface of a flat can with imparters of swivelling motion placed on either side in their initial position.
Figure 4A:
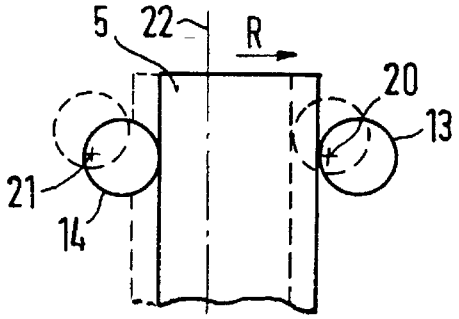
FIG. 4*a* shows an imparter of swivelling motion while swivelling to the right.
Figure 4B:
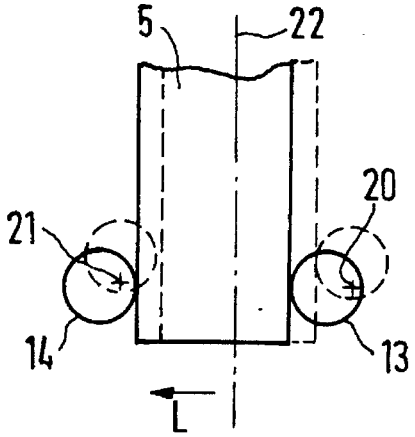
FIG. 4*b* shows an imparter of swivelling motion while swivelling to the left.

The imparters of swivelling motion 13, 14 may be installed advantageously on the underside of the machine table 4. The imparters of swivelling motion are guided by a control device 100. The control device 100, through its program, causes both imparters of swivelling motion to swivel at the return point simultaneously in a common direction perpendicularly to the traversing path. The flat can is thus swivelled. When a return point A or B is reached, this is signalled to the controlling device 100 by sensors 101, 102 which are respectively installed at the return point A and B. When the can reaches its other return point, the imparters of swivelling motion swivel the flat can around the swivelling axis 17, 17' in the opposite direction perpendicularly to the travelling path. For this purpose each individual imparters of swivelling motion is equipped with a controlled drive. The operation of these imparters of swivelling motion is represented schematically in FIGS. 4 to **4*b*. The drawings show a top view of the flat can 5 as seen from the underside from the machine table 4. The rotary plate located in the machine table 4 is outlined schematically by a broken line in FIG. 4. FIG. 4 shows an initial basic position of the flat can 5. An empty can supplied by the conveying system is, for example, positioned in this manner before the filling process begins. This applies similarly also to the filled can which is then to be transferred to a conveying system. The swivel axis 22 is symmetric with the lateral sides of the flat can 5. The swivelling device 15 is located in the upper can area 19. The top view shows that imparters of swivelling motion 13, 14 are located on either side of the can sides. They are advantageously designed in the form of rollers, each of which is connected to an eccentrically mounted axle 20, 21. It is also possible to use other means, equivalent to the roller. These rotation axles 20, 21 may be attached for example on the underside of the machine table 4 and therefore extend perpendicularly into the image place of FIG. 4. As is furthermore clearly visible, the rotary plate 2 in the machine table 4 is located between the imparters of swivelling motion 13, 14, but is in one plane with the machine table. For the sake of clarity the rotary plate 2 is not shown in FIGS. 4*a* and 4*b***.

FIG. **4*a* shows the swivelling of the flat can 5 when the flat can has reached a return point (not shown). The one face away from the return point is shown with part of the lateral side. In the present example the flat can 5 is being swivelled around axles 20, 21 to the right R by rotation of the imparters of swivelling motion 13, 14** made in the form of rollers.

FIG. **4*b* shows the process when the other return point is reached. The imparters of swivelling motion 13, 14 which are made in the form of rollers rotate in the direction opposite to that of FIG. 4*a*. As a result the flat can 5 is being rotated around swivelling axis 22 to the left L. The swivelling axis 22 of FIGS. 4 to 4*b* corresponds to the swivelling axis 17, 17' of FIGS. 1 and 2**.

Figure 5:
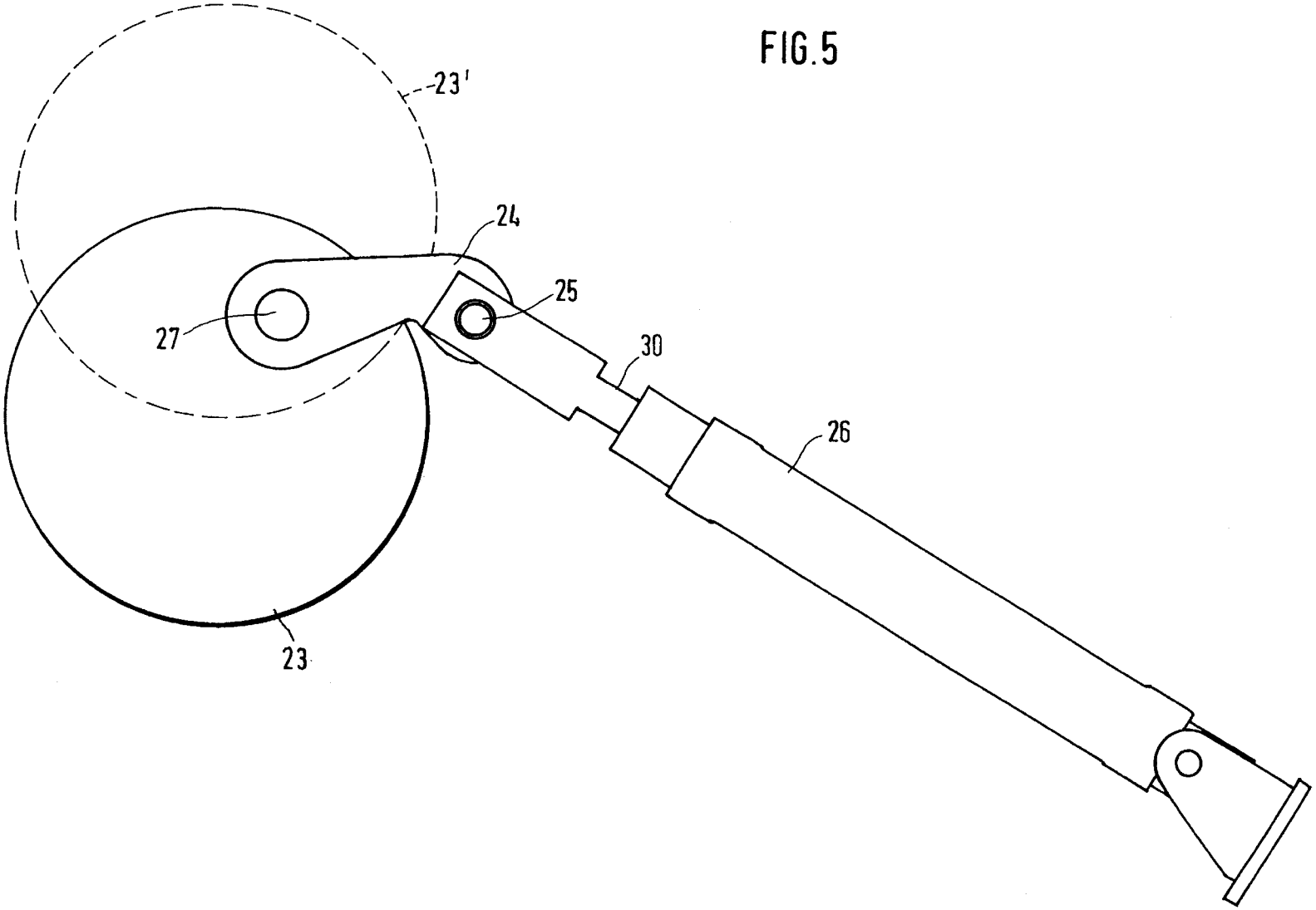
FIG. 5 shows an imparter of swivelling motion with adjusting device.

FIG. 5 shows a possible embodiment of the imparters of swivelling motion. An imparter of swivelling motion 13, 14 can be made in the form of a roller 23, for example. The roller 23 has an eccentric axle 27. An adjusting lever 24 is rotatably installed in this axle. The adjusting liver 24 is brought by axle 25 into engagement with an adjusting device which may be a pneumatic cylinder 26. The roller is designed so that when the piston rod 30 of cylinder 26 is pushed or pulled, the adjusting lever 24 is able to displace the roller 23 between its shown position and the position of roller 23'. Push or pull of the piston rod 30 is caused by the control device 100 which is connected via connecting lines 103, 104. The surface shell of the roller 23 is rotatable relative to the basic body of the roller. The basic body is connected to the axle.

Each cylinder 26 is actuated by the control device 100 which in turn receives its signal from one of the sensors 101, 102 which signal the arrival of the can at the return point A or B.

Figure 6:
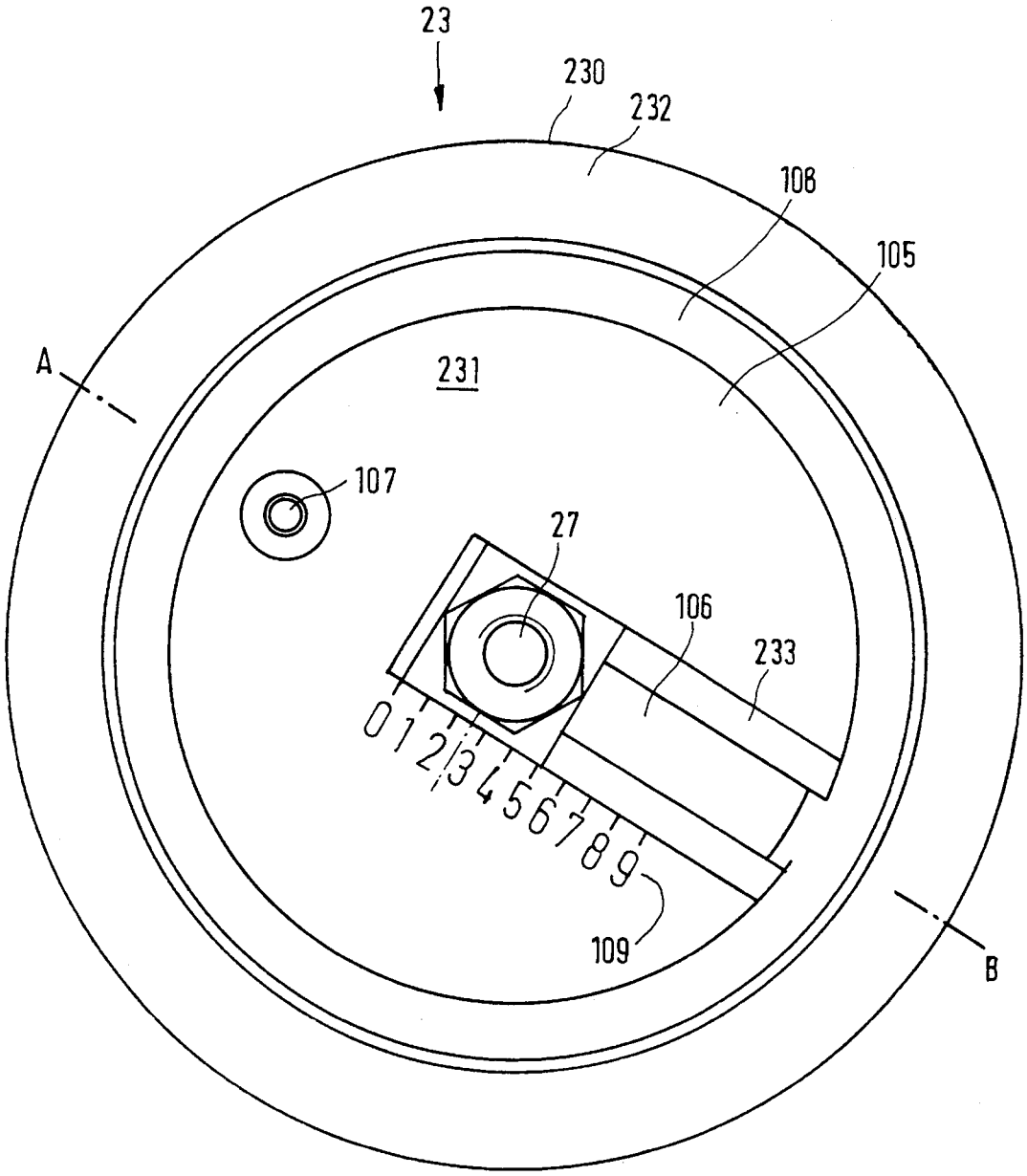
FIG. 6 is a top cross-sectional view of a roller of the imparter of swivelling motion.

FIG. 6 schematically shows the structure of a single roller 23. The view is directed upon the roller 23 in the direction of the underside of the machine table 4.

The roller 23 has a surface shell 230 constituted by a ring 232. The ring 232 is rotatable relative to the basic body 231 by means of a roller bearing 108. The basic body is formed by the hub 233 with oblong opening 106 and corresponding cover plate 105 which also does not cover the oblong opening 106. The cover plate 105 is attached by means of screw connection 107 to the hub 233. This described basic body 231 is located in the axle 27. The basic body 231 can be shifted and fixed by means of the screw connection 234 in the oblong opening 106 according to the measuring scale 109. In this manner the degree of eccentricity of the roller 23 relative to the axle 27 can be adjusted.

Figure 7:
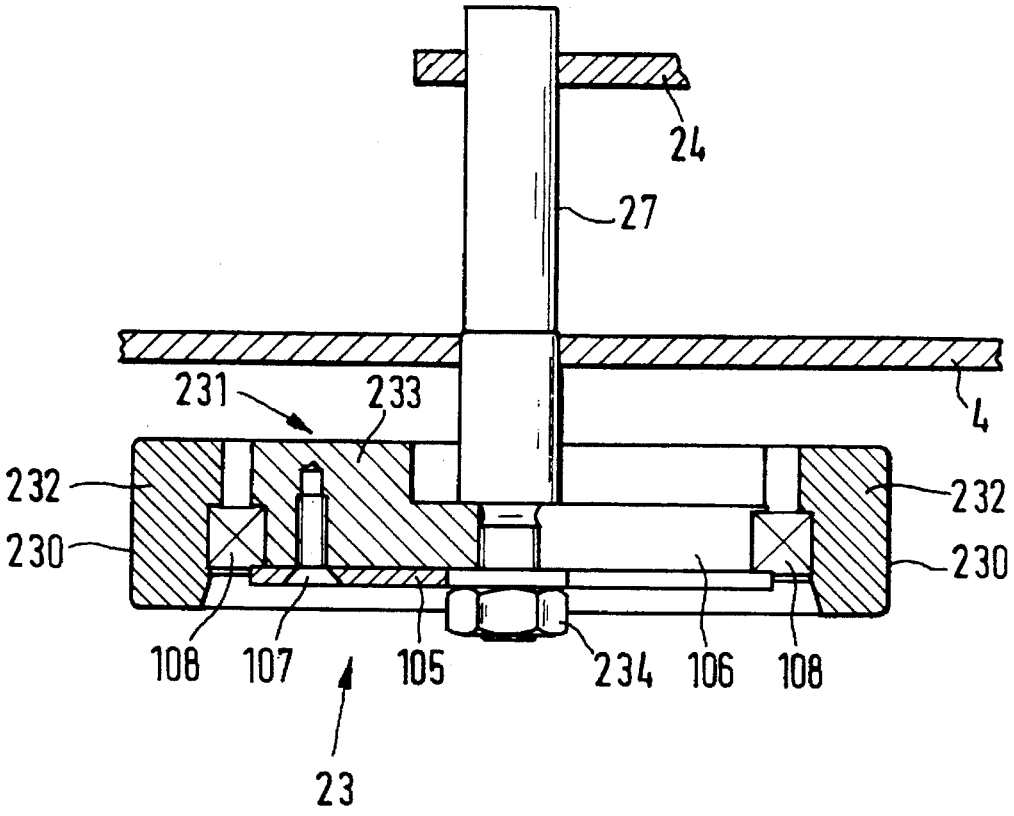
FIG. 7 is a side cross-sectional view of the roller shown in FIG. 6.

FIG. 7 shows roller 23 in particular along section A-B from FIG. 6. The adjustability of the eccentricity of roller 23 by shifting the roller in the oblong opening 106 can be seen here. The rotatability of the surface shell 230 of ring 232 relative to the fixed basic body 231 is furthermore made clear. The rotation starting at the adjusting lever 24 is transferred to the axle 37 and finally to roller 23. Thus it is possible to swivel roller 23 by a desired angle.

It will be apparent to those skilled in the art that various modifications and variations can be made in the present invention without departing from the scope and spirit of the invention. For example, features illustrated or described as part of one embodiment can be used on another embodiment to yield a still further embodiment. It is intended that such modifications and variations be covered by the present invention as come within the scope of the appended claims.

We claim:

1. A device for swivelling a traversing flat can of a textile machine wherein the textile machine delivers a fiber silver to the flat can, said device comprising:

a traversing mechanism configured to drive an elongated flat can between return points along a back and forth longitudinal traversing path relative to the elongated direction of said flat can, said traversing mechanism having grasping plate devices for grasping a flat can therebetween; and a swivelling mechanism configured to alternately swivel the flat can in opposite directions essentially perpendicular to said traversing path at each of said return points, said swivelling mechanism having swivelling members for contacting the flat can in an upper area of the flat can above said grasping plate devices and imparting said swivelling motion to the flat can.

2. The device as in claim 1, wherein said upper can area is delimited by said grasping plate devices and an upper can rim of the flat can.

3. The device as in claim 2, wherein said swivelling members are disposed at a height essentially at said upper can rim of the flat can.

4. The device as in claim 1, wherein said swivelling members comprise oppositely facing members disposed on either side of the flat can.

5. The device as in claim 4, further comprising a machine plate and a rotary plate configured therein, said rotary plate having a silver guiding channel defined therethrough for conveying the fiber silver into the flat can, said swivelling members disposed on an underside of said machine plate oppositely facing each other across from said rotary plate.

6. The device as in claim 5, wherein said swivelling members comprise rollers, said rollers rotatable about an eccentrically disposed axle and rotated through actuation of an adjusting member operably configured with said roller relative said eccentric axis.

7. The device as in claim 6, wherein said adjusting device is actuated by a piston rod and controlled cylinder system.

8. The device as in claim 7, further comprising a control device for automatically actuating said piston rod and controlled cylinder system, said cylinder in communication with said control device through a connection line.

9. The device as in claim 6, wherein said rollers comprise a base body which is rotatable relative to said eccentric axle and a surface shell which is rotatable relative to said base body.

10. The device as in claim 6, further comprising a system for adjusting the eccentricity of said eccentric axle relative to said roller.

11. The device as in claim 10, wherein said rollers comprise a base body, said adjusting system comprising an oblong slot formed in said base body with said eccentric; axle being variably positionable within said oblong slot.

12. A device for swivelling a traversing flat can of a textile machine wherein the textile machine delivers a fiber silver to the flat can, said device comprising:

a traversing mechanism configured to drive a flat can between return points along a back and forth longitudinal traversing path relative to said textile machine, said traversing mechanism having grasping plate devices for grasping a flat can therebetween; and a swivelling mechanism configured to alternately swivel the flat can in opposite directions essentially perpendicular to said traversing path at each of said return points, said swivelling mechanism having swivelling members for contacting the flat can and imparting said swivelling motion to the flat can, said swivelling members comprising rollers, said rollers rotatable about an eccentrically disposed axle, and rotated through actuation of an adjusting member operably configured with said roller relative said eccentric axis.

13. The device as in claim 12, wherein said rollers are disposed above said grasping plates so as to contact the flat can in an upper area thereof.

14. The device as in claim 12, wherein said rollers are disposed below said grasping plates so as to contact the flat can in a lower area thereof.

15. The device as in claim 14, wherein said traversing mechanism comprises grasping plates configured to grasp the flat can therebetween and convey the flat can along said traversing path, said rollers disposed above said grasping plates so as to contact the flat can in an upper area thereof.

16. The device as in claim 14, wherein said traversing mechanism comprises grasping plates configured to grasp the flat can therebetween and convey the flat can along said traversing path, said rollers disposed below said grasping plates so as to contact the flat can in a lower area thereof.

17. A device for swivelling a traversing flat can of a textile machine wherein the textile machine delivers a fiber silver to the flat can, said device comprising:

a traversing mechanism configured to drive an elongated flat can between return points along a back and forth longitudinal traversing path relative to said elongated can; and a swivelling mechanism configured to alternately swivel the flat can in opposite directions essentially perpendicular to said traversing path at each of said return points, said swivelling mechanism having swivelling members for contacting the flat can and imparting said swivelling motion to the flat can, said swivelling members comprising rollers, said rollers rotatable about an eccentrically disposed axle and rotated through actuation of an adjusting member operably configured with said roller relative said eccentric axis.

* * * * *